US006880729B2

(12) United States Patent
Stull et al.

(10) Patent No.: US 6,880,729 B2
(45) Date of Patent: Apr. 19, 2005

(54) SECURE LOCK CLOSURE

(75) Inventors: Gene Stull, Far Hills, NJ (US); Robert T. Auer, East Stroudsburg, PA (US); Jameson P. Stull, Far Hills, NJ (US)

(73) Assignee: Stull Technologies, Somerset, NJ (US)

( * ) Notice: Subject to any disclaimer, the term of this patent is extended or adjusted under 35 U.S.C. 154(b) by 115 days.

(21) Appl. No.: 10/194,818

(22) Filed: Jul. 12, 2002

(65) Prior Publication Data

US 2004/0007595 A1 Jan. 15, 2004

(51) Int. Cl.[7] ..... B67D 5/378
(52) U.S. Cl. ..... 222/153.14; 215/216
(58) Field of Search ..... 222/153.14, 153.04, 222/541.5; 215/216; 220/306

(56) References Cited

U.S. PATENT DOCUMENTS 3,744,675 A * 7/1973 Song ..... 222/153.14
4,127,221 A * 11/1978 Vere ..... 222/153.02
4,852,770 A * 8/1989 Sledge et al. ..... 222/153.14
5,356,017 A * 10/1994 Rohr et al. ..... 215/216
5,577,626 A * 11/1996 Henkel et al. ..... 215/237
5,605,254 A * 2/1997 Wagner et al. ..... 222/108

* cited by examiner

*Primary Examiner*—Gene Mancene
*Assistant Examiner*—Melvin A. Cartagena
(74) *Attorney, Agent, or Firm*—Drinker Biddle & Reath LLP

(57) ABSTRACT

A secure lock for container packaging with a flexible retaining lip of various formations for sealing against material product flow distributions with the secure seal preventing tampering of, for example, a flexible walled container of material such as a medication, food stuff or art material. A resistant secure lock is provided which in one embodiment meets Federal Child Safety Standards providing a seal of flexible locking and unlocking which is resistant to a child's tampering.

In one embodiment, a tamper resistant seal is formed for a squeezable container cap with a flexible hinging structure connecting a cap to a cap receptor base structure of a container to prevent a material product such as medicine from dispensing without disengaging the seal selectively to allow access to an aperture, yet with a directed flexion of a lip or head, the seal simply unsnaps from a tamper resistant state to release the flow of product through an aperture from a container.

20 Claims, 6 Drawing Sheets

SECURE LOCK CLOSURE

B. CROSS REFERENCE TO RELATED APPLICATIONS

None

C. STATEMENT REGARDING FEDERALLY-SPONSORED RESEARCH ON DEVELOPMENT (N/A)

D. REFERENCE TO SEQUENCE LISTING (N/A)

None

E. BACKGROUND OF THE INVENTION (1) Field of Invention

The present invention is directed to closures and more particularly, to the secure lock closure of, for example, a safety closure via a child-resistant lock.

(2) Description of Related Art Industry Information Disclosed Under 37 CFR 1.97 and 37 CFR 1.98

There is a need among known dispensers with product to be dispensed which require hands to open, typically with one hand to open a container, to provide a child resistant safety seal for example. A need exists for securely containing a product to be dispensed as squeezed from a container or dispersed from a container well, and the subsequent need to provide a cap opening which is safe for usage yet, for example, "child" resistant as well as tamper proof in closure, providing a secure seal yet easily accessible with a simple action such as flipping open with a finger while a hand gribs a container for example. There is often a risk a curious child could open a secure squeeze bottle opening a container, and ingesting the medications or other consumer product such as pills or fluids, a problem resolved by the disclosed invention. Elegance of design for consumer appeal, yet safety from little hands, or for that matter, safety for all consumers while achieving a secure structure with ease of use in opening, is an objective of the safety secure lock closure herein.

The lock top can be composed of a plastics such as polypropylene and other moldable materialto form the secure lock closure of the disclosed invention. Polypropylene can provide lightweight, resilient, hygienic, corrosion resistant structures with ease of molding and customization.

Polypropylenes provide functional performance and properties similar to conventional thermoset rubber products, but can be processed with the speed, efficiency and economy of thermoplastics.

In addition to simpler processing, principal advantages of polypropylenes compared to thermoset rubber products include easier recycling of scrap and closer, more economical control of dimensions and product quality.

Other benefits of polypropylenes include improved cost/performance, design flexibility, reduced weight, wide service temperature range, ease of processing, superior product quality and dimensional consistency and can be recycled in-house.

The disclosed invention can comprise structures, which can be molded or formed in varying ways for example, as thermoplastics for example, with linear, branched linear or branched molecular structures of varying molecular length. Variations in durometer i.e. hardness of structures of the disclosed invention can be achieved by composing polymer structures by varying polymer formation aspects of time and temperature at the time of curing, for example.

Other foreseeable materials can be utilized such, for example, plastics to mold or form the customizable structure of a secure top.

In one embodiment, a closure in conjunction with a flexible walled container is intended to dispense product, while providing a secure closure which is easy to use, yet resistant to tampering, for example, from a child or patient with Alzheimer's. The closure can be made in varying ways for example from injection-molded plastics such as polypropylene or other plastic material for ease of manufacture.

In one embodiment, the closure design disclosed provides the advantage of being secure from tampering by a child opening a closure inappropriately due to a novel molded structure with flexible locking pins or of a closure formed of pin and gating easily unlocked by knowledgeable hands accessing, a pin in a groove made from, polypropylene or other formation material comprising a cap and lock forming a secure juncture.

Material to be dispensed via the lock top can materially flow through a small opening such as an airway—for liquids, talc, or other foreseeable consumer materials.

As an alternative design, the lock top design can be molded or formed to allow the wall to which the locking pins connect at bottom to have an opening, the aperture through which pills or other material can flow through. The opening of the wall bottom to which locking pin or pins connect, for example, by molding with a variation in size, allows for dispensing pills based on the sizing of the opening of the wall bottom to which the locking pins extend from connecting to a cap which can be toggled and opened to allow pills to go through an opening based on size variation of an orifice for example formed or set at molding time, designed to meet, in one embodiment, Federal Child Safety Regulations, as well.

Another object of the closure invention disclosed is that it can be utilized for all types of products, under varying conditions, and for varying amounts of material for dispensing, by varying the customizable design for variations in container and material size or item.

An additional object of the closure in one embodiment is to provide flexibility of the cap hinging and locking with the design of the cover cap providing a passageway for dispensing, for example, liquids or particular matter while acting as an air passageway.

An object of the invention is that the lock top can be formed and assembled in several different ways and still achieve the same successful secure seal for dispensing selectively yet tamper proof to, for example, a child's tampering hands. From a separate molded piece, the lock top can be inserted on or inside a container, for example, and then the cap locked in place by in example embodiments, either moving a flexible hinge or hinging structure such as a strap engaging the cap top with a locking lip or lips of a vertical locking pin structure extending from the cap base structure or having a totally separate cap alternatively without a hinging structure relying on the cap to engage at least one of potentially several flexible locking pins extending from said cap structure. The injected molded lock top can also be co-injected or insert molded directly and formed on or into a nozzle, when used with compatible material, or just as easily screwed on, or snapped to snuggly hold to a container from an inner ring structure extending from the inner wall of the base structure.

Tamper-resistant to, a child's tampering for locking tops are disclosed in one embodiment, with varying embodiments providing various methods to make a one-piece tamper-resistant flip top dispensing closure which is part of a container or attachable to a container in alternative embodiments while conforming to Federal Guidelines for child safety.

Variant designs provide alternate locking methods developed. For example, as a "Squeeze N' Lift Double Lock Top" alternate variant embodiment, a secure locking method is provided of an appealing exterior appearance that is functionally secure yet aesthetically appealing. It is a goal of the disclosed invention to achieve, for example, a child-resistant packaging with a closure that cannot be opened by children or other tampering hands, but also allows seniors to successfully open and close the closure for dispensing from a packaging such as a container. The secure closure can, in one embodiment, foreseeably meet with criteria according to specific government guidelines for safety.

An achievement of the disclosed invention is an unique secure, tamper proof closure, as well as a coordinating container for selective sealing.

Another goal of the disclosed invention is to provide safety protection of the public, yet with coordination of the closure to customizable aperture dimensions for dispensing, providing the ability to control who can open the bottle via a flexion closure action disengaging a top cap from a lock, resisting tampering.

Other objects and advantages of the present invention will become apparent from the following descriptions, taken in connection with the accompanying drawings, wherein, by way of illustration and by example, by the varying embodiments of the present invention disclosed.

These and other objects of the invention, which shall become hereinafter apparent are achieved by the Tamper Resistant Safety Locking Top.

F. SUMMARY OF THE INVENTION

In one embodiment, a cap closure has a locking shape such that at least one of several prongs with engageable lips which are each flexible to allow for locking and unlocking following a manual activated flexion of the locking means provides a tamper resistant closure. The closure is resistant to, for example, a child's tampering with a novel closure in conjunction with a cap-top amongst other features. The locking closure top is preferably comprised of a selected material comprising injection molded structures formed of plastics such as polypropylene or other material which retains an initial shape memory after being deformed i.e. substantially retains its initial molded shape following the flexion and deformation of the engageable lips to lock and unlock from the cap top. The lock cap can secure a container from dispensing while further providing a cover cap which can seal an air passageway which also can be utilized for dispensing material from a container. The opening of the cap base structure can provide an air influx passageway or channel for material dispensation in varying embodiments. Further, the design can be provided but not limited to, for example, a singular molded piece, and can alternatively be formed as an aperture with the container for selectively securing a dispensing container.

G. BRIEF DESCRIPTION OF THE DRAWINGS

The invention will be better understood by the detailed description of a preferred embodiment, with reference to the drawings, in which:

FIG. 1 is an example of a view of the squeeze and lift activated locktop with, in one embodiment, a double locked aperture with cap (10) engaged with cap base via lips (30) structure (20) shown in a closed state. In the figure shown, the one-piece construction is in a closed state, and can foreseeably molded to a container in another embodiment.

FIG. 2 is an example of a top view of the closure showing how the two lips (30) or headed sides of the locking pins slidably engage with the cap (10) apparatus to form into a closed position state securing any air way from dispensing and preventing tampering from this example closed position of the closure. The cap (10) in a closed state keeps the closure in a selectively locked state and prevents material from dispensing. The lips or overhanging headed sides are flexed into a secure locked position with the cap and lock top engaged in a closed and secure state; yet with a simple "pinch" of a finger in a groove (12) can flex the lip or lips to the side to disengage from the cap, a user can lift the cap which is one embodiment is hinged, open from a tamper resistant state to allow a consumer to squeeze a container for material flow through the cap. A design is equally possible with the cap not connected permanently to a base, for example absent a hinging means such a flexible hinge or strap.

Within FIGS. 3A and 3B, shown as in FIG. 3A, is an example of a side view of the lock top made from, for example, polypropylene for flexibility, with the living hinge or foreseeably other hinging means such as a strap flexibly holding a cap (10) molded shown with, from the top most view, the cap lock action shown in the closed state; the cover cap (10) automatically locked with the lip or lips (30) engaged with the cap (10) in a closed secure state;

FIG. 3B is an example of a side view of the closure shown from as an example of the locking lip action disengaged (32) with a flexing action to selectively provide a locking or unlocking state. By squeezing the locking lips into a position to dispense; a cap can be unlocked and flexibly hinged into an open position or snapped into a closed position, with the lips (30) re-engaging the cap (10) providing a tamper-proof seal.

FIG. 4A is another example of the locking top with locking pin (34) or lip (30) visible from a side view, shown in an open position with a cap (10) with a top cover cap open with a single lip (34) assigned for engagement and closure with a "flip" of the hinged (50) cover cap (10) engaging the flexible pin (34) or lip (30) into the aperture (16) of the cap slidably engaging the cap into a sealed state of closure and snapping into place (40);

H. DETAILED DESCRIPTION

Figure 4B:
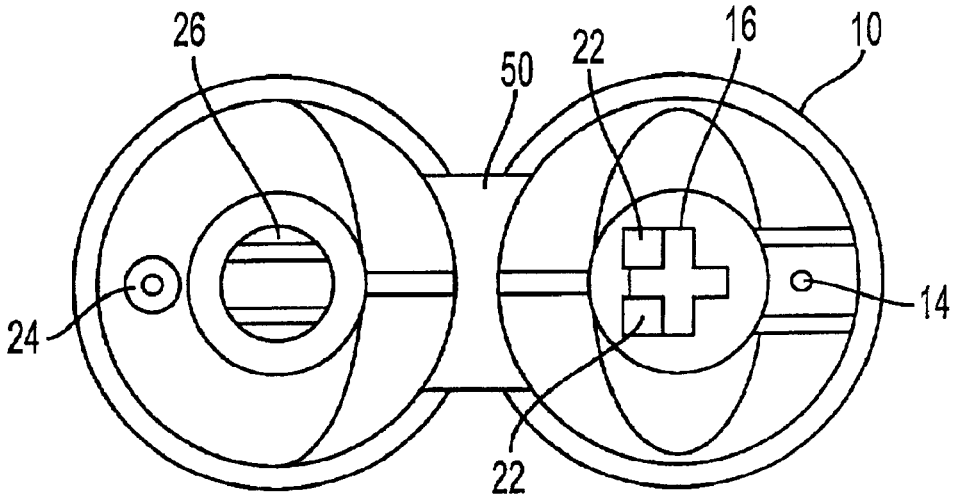
FIG. 4B is a side view of the hinged cap with the lips (30) or head structure (34) open and ready for closure by a consumer flexing the living hinge (50) to engage the head structure (34) or lip (30) into the aperture (16) of the cap (10)
Figure 4A:
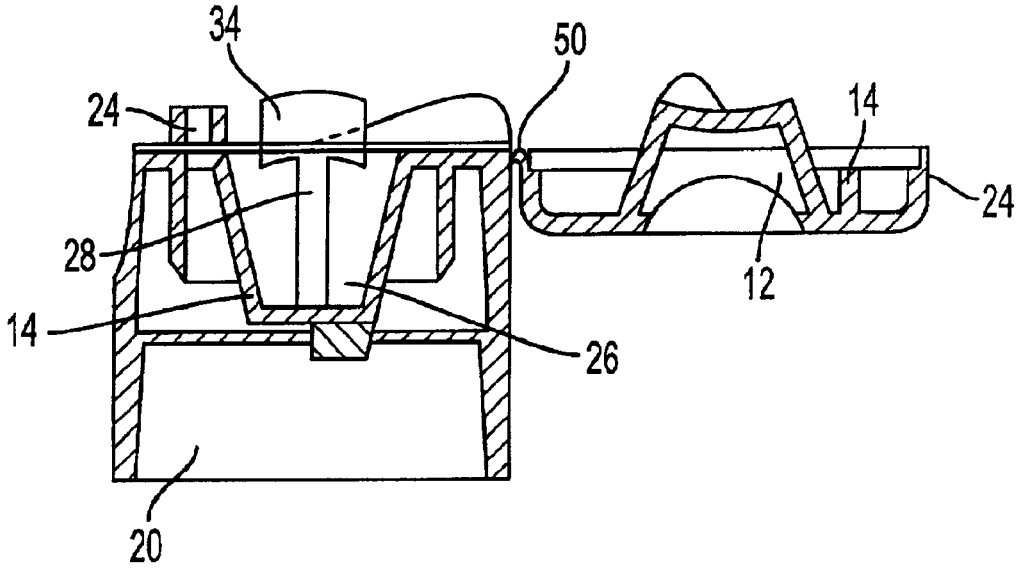

As an example embodiment, a "squeeze n' lift" double lock top can be formed as a one-piece injection molded dispensing closure, molded in an open position as shown in FIG. 4A. The base (20) and cap top (10) cover sections are held together with a flexible living hinge (50). This example closure, is intended to be used in conjunction with flexible walled containers and can dispense products from, for example, an inverted position of a container to which the closure is connected or by squeezing a container to force material through an aperture of the .cap base structure.

Figure 2:
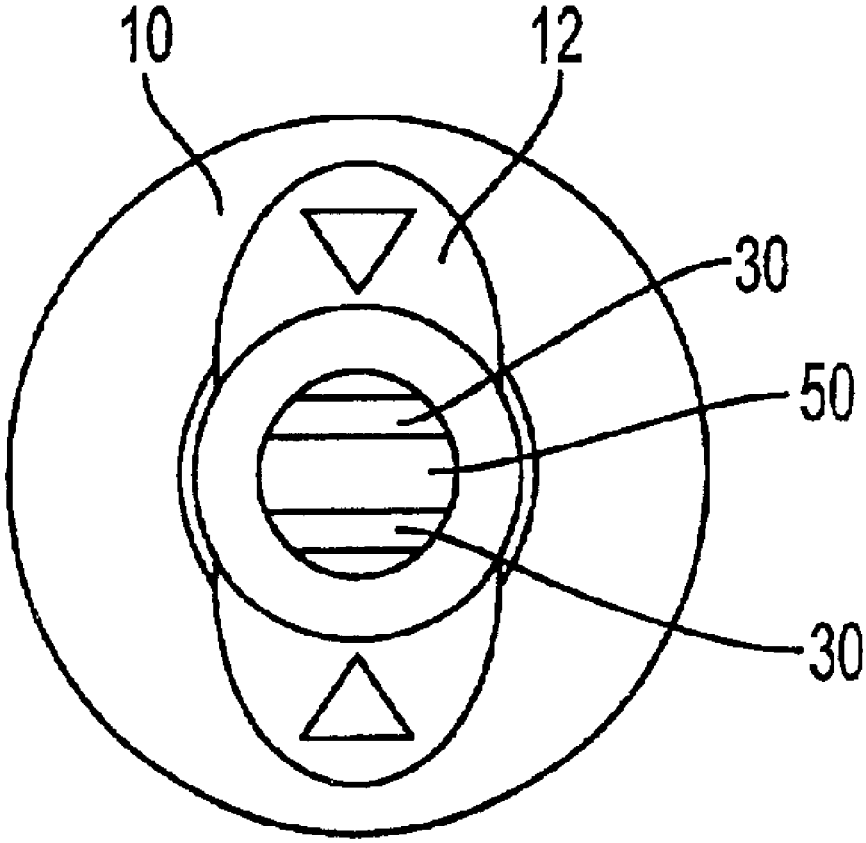
Figure 3B:
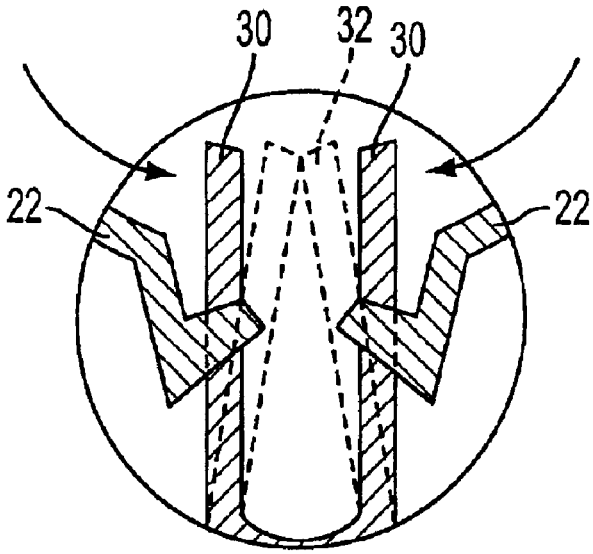
Figure 3A:
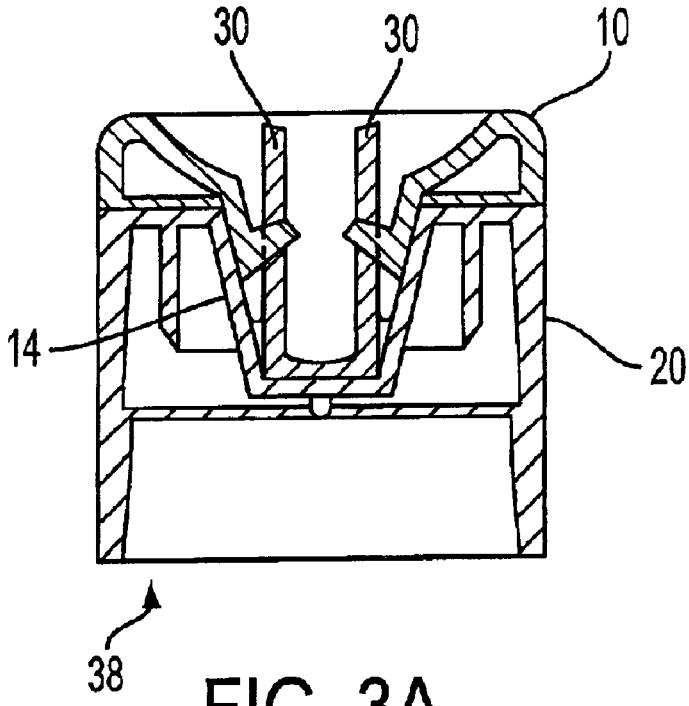

In such an example embodiment, as shown in FIG. 3 located at the center of the base cap (20) are two flexible vertical locking pins (30) with extended overhanging head sides (30) at least one (34) as shown in FIG. 4 of two (30) or (39), for example. As the top cover cap (10) is being closed, a locking pin (28, 30, 34) extending from the base are flexed together (32) and forced through an open aperture or apertures of the cap lip bud receptors (16) located, for example, at the center of the cover cap (10). When the cover cap (10) is closed, the locking pin or pins (28, 30, 34) flexibly return to their substantially original vertical molded positions (30), causing the overhanging side top area (34) of a pin or pins (30) to slidably engage into at least an opening (16) of the cover cap (10), creating a locking condition which is child tamper resistant The vertical pins (30) or pin (34) can cycle and flexibly return to a substantially original molded state position due to the inherent memory of the material for example, in one embodiment, such as polypropylene. One or more pins (28, 30, 34) are automatically in the locked position (36) when the cover cap (16) is flexibly hinged to a sealed position. To make it more convenient for the consumer to unlock the top cover cap (10), a design embodiment, for example, includes enlarged extended recessed finger areas (12) on both sides of the cover cap (10) as shown in FIG. 2. The bottom of the base structure allows for adhesion to a container or alternatively can be molded as one part with a container body of flexible walling.

In one embodiment, to open the cover cap the consumer must flex one or more locking (32) pins to unlock simultaneously and lift the hinged (50) cap (10) in tandem, sliding both pins through the center open lip bud receptor aperture (16) of the cover cap (10). The cover cap (10) can be opened and closed as many times as required by the consumer. The open dispensing nozzle (24), for example, forming an aperture located on the top front section of the base cap (20) and the plug or pin (14) to close a structure can be located on the inside of the cover cap as shown in FIG. 4. A hinge (50) controls the registration relationship between the nozzle (24) and sealing plug (14), in one example embodiment.

Figure 1:
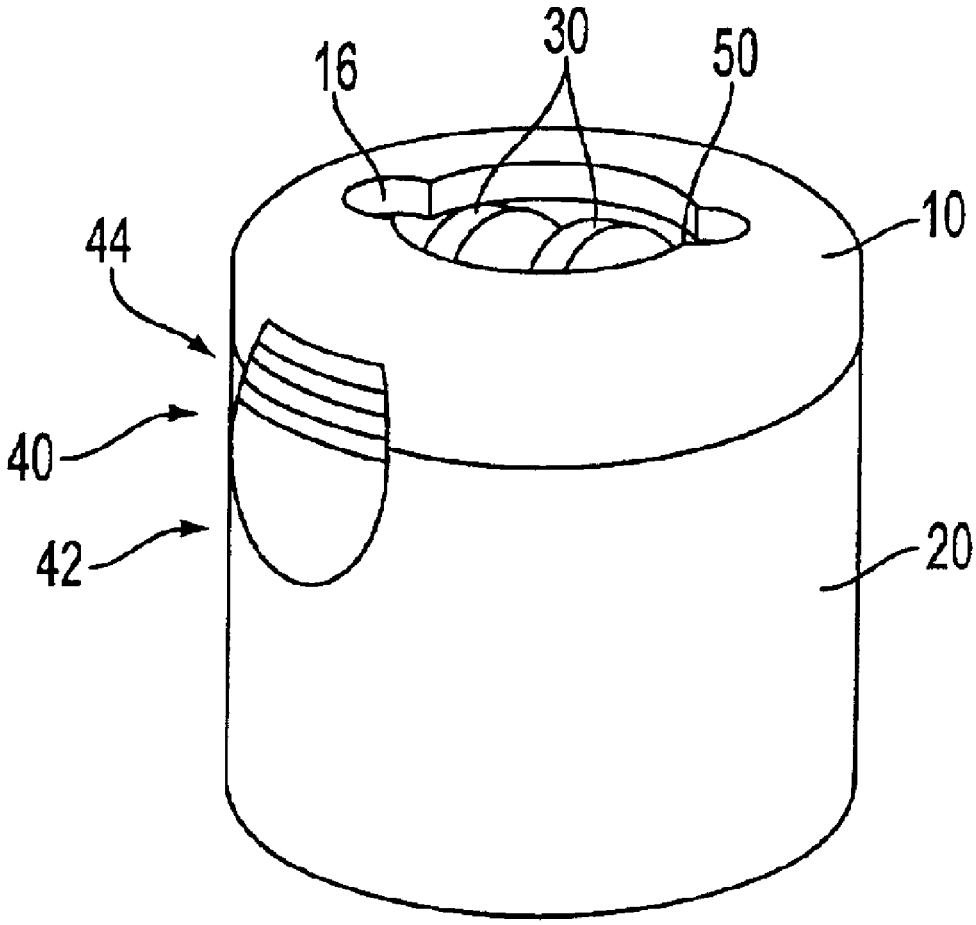

Referring to the drawings wherein like numerals reflect like elements throughout the various views, in one embodiment, a cap (10) can be formed with a flexible hinge (50) attached as a apertures to a base structure (20) as shown in FIG. 1 that is precisely formed to provide a secure closure (40) that is snug. Yet the seal is also easily controlled to flexibly open when an external force is applied to the lip lock (30) or head (34) of a containment lock to flex a pin head (28, 30, 34), moving the pin bud from a secure state, to a disengaged open position relative to a cap lip bud receptor opening (16) unlocking and sliding the cap (10) hingedly connected into an open position.

The selection of a resilient material, such as polypropylene, for example, or any other compatible memory retaining material which gives the disclosed invention's lip lock or pinhead (28, 30, 34) the ability to flex and retract and lock (36) forming a secure seal (40) when the cap is flipped again to close and cycle again to relock, with external application of pressure to unlock a seal by flexing the lip or head (28, 30, 34) to slidably unlock from a secure position. Polypropelene has a slippery feel for a good consumer grip, yet hardened vinyl, or other types of rubber such as a harder durometer rubber, silicon, or nylon are foreseeable structural forms. Resins of polypropelene can be of varying density and coloring, yet polypropelene provides a relatively inexpensive material for one embodiment of the disclosed invention. The density of polypropylene can foreseeably be customized for alternative embodiments.

Each of the molded lip or head (28, 30, 34) connected to the base structure (20) disclosed is synchronized to slidably perform a lock and unlock function flexibly when an external force is applied to move the lip or head (28, 30, 34) of the container base structure (20) in the closed position with a cap (10) which slides through receptors (16) as shown in FIG. 1. The lip or lips (30, 34, 28) connected within the base structure (20) to a bottom wall (26) are flexible and living hinges (50) allow the cap (10) as shown in FIG. 2 to be secured in conjunction with the lip (30) or lips secured or moved again to disengage and open from a locked state (36) to allow a container to have apertures (24), (64) for dispensing material flow.

Figure 5B:
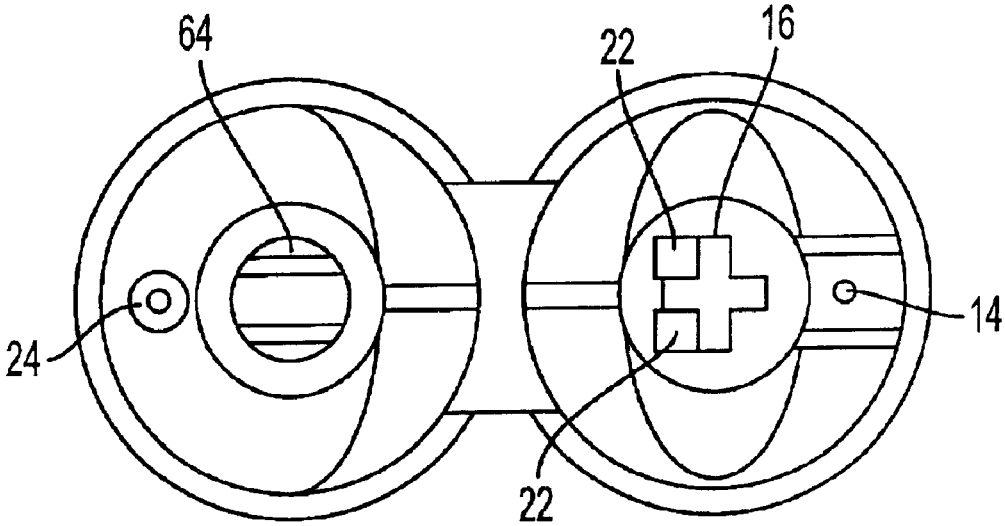
FIG. 5A and FIG. 5B are side views showing the base cap in open position with, in another example embodiment one open air slot orifice (64) and a lip locking pin (30) whose bottom connection wall (26) can have a nozzle (24) as well as an customizable aperture (64) set at forming time for example for dispensing variant pill sizes as an alternative design embodiment.
Figure 5A:
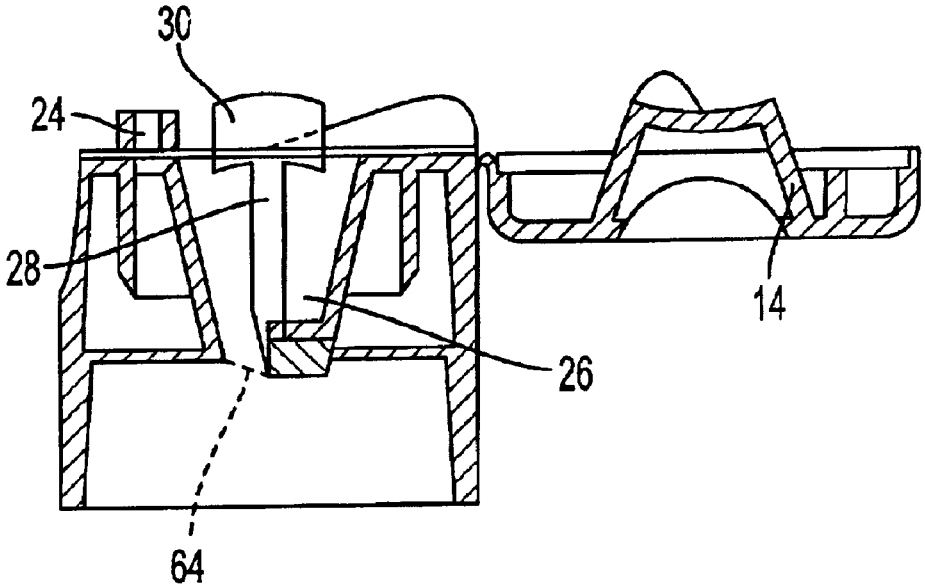

As shown in FIG. 5, the unlocking of the lip (30) i.e. of heading locking pin (34, 28, 30) from the cap (10) allows a pill, for example, to be dispensed through an aperture in the center section of the bottom wall (26) from an orifice (64) which approximates pill size as an alternative embodiment after flexing the lip locking pin head lip to, in one embodiment, snap from the cap lip bud receptor (16) aperture, disengaging the hinged the cap and flipping the cap (10) and cap structure to an open state. When the lip is moved into this position, it is unlocked from the cap (10) and the cap (10) can be lifted open and enable the top cap (10) to hinge (50) outwardly material or air can flow through a nozzle as well (24). This transition from a closed state of FIG. 1, for example, to an open state (FIG. 4 and FIG. 5), allows flow of product dispensation through apertures (64) or slits or open nozzles (24) or that foreseeable apertures that are normally sealed in the closed position of the disclosed invention by the cap (10) and lock connection (34), for which the lips of the locking pins (30, 34, 28) engage in locked position and from an unlocked position allow for an opening for dispensing. In alternative embodiments, pill size and other material for containment can determine tooling layout, cap size, gating or piercing of the wall bottom (26) for aperture opening sizing (64) or placement of an aperture means for product flow with alternatively positioning, variations in placement on a wall (26) to provide a secure closure.

Figure 6:
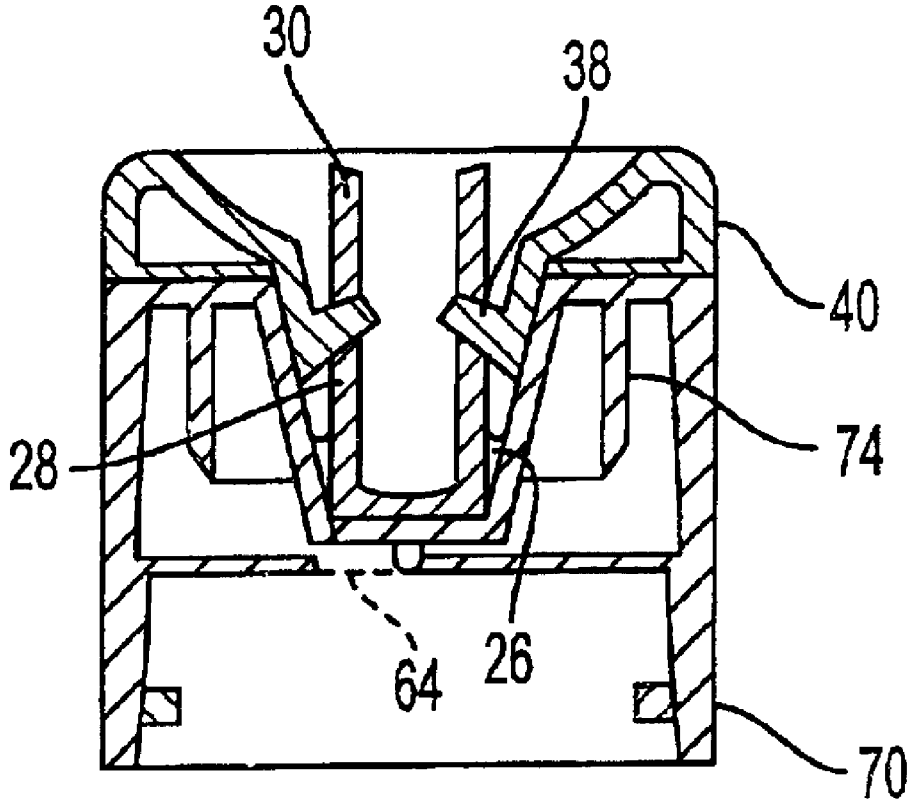
FIG. 6 is a side view showing a one piece construction cap with single locking pin in position, with an airslot and orifice variant design.

For example, as shown in FIG. 6, a side view is presented showing a secured closed storage position with the base cap (10) in locked position with, for example, the air slot (64) closed. The base cap can snap snuggly into place to seal on a container from an inner ring structure (70) extending from the inner wall of the base structure snapping to a receptive engagement ring structure on a container as one embodiment. As seen from a side view, the "nubs" of the side view shown in FIG. 6 are the inner ring (70) of the cap structure which can secure to a container neck as yet another embodiment. Alternatively, the connection to a container can be embodied instead of as an inner ring to connect to container rather as a groove to slide unto a receptive container neck with an exterior ring to engage forming a tamper resistant whole unit with a container.

A tapered wall which forms a internal skirting structure can also slidably engage with a container, allow the cap optional hinging structure and cap structure to attach to a container in a self balancing procedure.

FIG. 3 is an example side view of the squeeze and lift double lock top (which can just as easily be implemented as a single lip (30) to lock as shown in FIG. 5), showing the cap in place such that the inner portion of the cover cap engages with the lips, snapping the cap (10) into place securely, preventing a cap from opening outwardly even with prying of the closure. With a simple snap and flexion of the lips, flipping the cap (10) open relying flexing on the living hinges (50) to extend the cap outward in a spring like action providing for flow through openings (24) (64) of the cap base structure (20) from, in one embodiment, a squeeze container.

For example, after dispensing the product, the locking lip action can snap lock the cap into position to allow for placement on a level surface during a container transition state.

The formed cap can be composed from material such as, but not limited to, polypropylene, which can, after a chosen cure time be composed in variations of structural formation and durometer all with the goal of providing a proper sealing. The size of opening or piercing along the cap structure container wall or cap to which the lips engage can be molded for varying dispensing of different material determined by the type of product to be dispensed.

As shown in FIGS. 3 and 4 variations of the directional locking lip (30) number and design with variant shapes of lock openings (16) and lock relationship to aperture as well as open and closed positions is foreseen, with select embodiments conforming to Federal Child Security Standards, for example.

The locking direction of locking lips (28, 34), (30) is shown in a vertical position relative to the base (20) as shown in FIGS. 3, 4, 5 and 6, yet could foreseeably be placed at a diagonal. The lip flexion is generally consistent and isometric in flexible engagement to the cap. In one embodiment, any aperture cap lip bud receptor (16) can have a gating wall (not shown) with the gating causing the flexing lips (30, 28, 34) to slide apart and slide into a lock catch (22) causing the catch to close to the cap providing a tamper resistant seal, in one embodiment, as a seal resistant to a child's tampering hands, which is safe, and secure as shown in FIG. 4 and FIG. 5.

An achievement of the disclosed secure lock closure is to provide a dispensing container for foods, art materials, or medicines for example with uniform dispensing of such material, with security from a child's prying hands, preventing, little prying hands from opening and ingesting medicine.

For example, FIG. 4 shows an equalized locking control with a centremost directional cap locking engagement for securing the dispensing engagement from a variation of the gating formation of a cap with, for example, a lock pattern with an equal, centercap engagement aperture (16) which can be flexed open flipping the cap from a secure state via the living hinge (50), and snapping back the cap to a closed state to achieve a closure of the cap in a secure state from the flexion of the lip or headed (30, 34, 38) structure locking with the cap.

In one embodiment, the cover cap is designed to enable a secure seal and air cannot enter an aperture when the cover cap is in the closed position as shown in FIG. 1, FIG. 3, FIG. 6. This directional airflow aperture or nozzle (24) of the disclosed invention allows material flow, yet can be sealed to meet Federal Child Safety Standards. After consumers dispense a product and snap the cover cap closed, the container lock recovers initial positioning preventing against flow of a material from dispensing and access, secure from tampering achieved, by the varying embodiments of the disclosed invention.

As an alternative embodiment of the many alternative customizable formations designs possible: the wall bottom to which the flexible lips for locking the gating, to which the gating connects can be made with a variation of size as an opening of ranging diameter. Creating an aperture through the wall that is presently solid from which the lips extend and selectively changing the diameter of this opening at molding and curing time can allow, for example, pills to flow through by customizably molding the aperture of the wall to pill size, for example, for example as small particles such as talc or fluid flow rate determined by the selectable sizing of the aperture. Apertures of the design can as provides air influx apertures.

The cap could be selectively be formed at a diagonal, etc.

Another alternative design is absent a hinging structure such as a flexible living hinging structure or strap in which the cap can disengage from the locking pins flexibly extending from a cap base structure While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A flexibly activated locking closure for secure product packaging of the type having a container with a discharge opening therein, said locking closure comprising:

a cap having a top outward facing surface;

a connection of said cap to a base structure;

said base structure having at least one aperture for dispensing; said aperture further comprising at least one of several of a pierced aperture, a tearout membrane aperture, or a molded structure aperture;

at least one of a flexible locking member with a lip portion to lock for slidably engaging to said cap with an engageable receptor within said cap for providing said connection of said cap to said base structure;

said connection further comprising a hinging structure; and a seal formed comprising said cap, said locking pin;

said base structure apon flexion of said locking pin through said engageable receptor within said cap when said cap is flexibly engaged to said base structure;

wherein the base structure includes a recessed portion, and wherein the flexible locking member is mounted in the recessed portion such that the top of the flexible locking member is located below the top surface of the cap when the flexible locking member is engaged with the receptor.

2. The closure of claim 1 further wherein said base structure is formed as a whole with a container.

3. The closure of claim 1 further wherein said base structure is formed with an air vent.

4. The closure of claim 3 further wherein said cap further comprises a pin for sealing said air vent.

5. The closure of claim 1 wherein said closure is resilient to environment factors comprising temperature; altitude; and material product for flow through said closure, further wherein said closure is formed via molding comprising injection molding, co-injected molding, or direct insertion molding further comprising a direct formation on or into a nozzle.

6. A secure closure for consumer packaging comprising:

a cap comprising a lip receptor and an outward facing toy surface;

a connection of said cap to a base structure which comprises a locking lip receptor engaging a flexible extension with a lip bud slidably engaging said cap securely to said base structure to form said connection; and said connection further comprises a hinging structure connecting said cap to said base structure;

wherein the base structure includes a recessed portion, and wherein the flexible extension is mounted in the recessed portion such that the top of the bud of the flexible extension is located below the top surface of the cap when the bud is engaged with the receptor.

7. A secure flex-to-open, closure construction of a cap and a lock activated for dispensing from a hand-held dispenser, comprising in combination:

a) a body base structure member having at least one discharge passage said discharge passage further comprises at least one of a pierced aperture, a tearout membrane aperture, or a molded aperture structure, said body member including a recessed portion;

b) a flexible body extension extending from said body member and being force flexed from a user-motion thereon between a sealing cap construction sealing position and a open to discharge position for material dispensing through an orifice, the flexible body extension being mounted in the recessed portion and extending upward such that the top of the flexible body extension is located below a top outer surface of the can;

c) said closure construction on said members for interrupting communication between the discharge passage and the discharge orifice when a nozzle member of said base structure is opened when said cap is lifted from a sealing position from said body extension flexion, and establishing an opening between the container interior for a material discharge passage and said orifice when the closure member is disposed in a discharging position such that said material can flow through at least one discharge passage of said base structure; and d) said closure construction reforming initial shape formation in a sealing position with a force applied to said cap to engage said cap to said flexible body extension.

8. A closure comprising a cap engageably forming a connection to a base structure;

said connection comprising a plurality of flexible locking pins, each locking pin comprising an enlarged head extending from a recess formed in said base structure for securely and releasably engaging with said cap, the enlarged head being located below a top outward facing surface of the cap when the cap is locked to the base structure;

said base structure comprising a nozzle; said nozzle further comprising a size set at a curing time;

further said base structure comprises a sealing inner ring for secure connection to a container;

said cap further comprising cap receptors formed on the can for engaging said cap to said pins, wherein the enlarged head of each locking pin releasably engages with one of the cap receptors for locking the cap to the base structure;

further said pins are flexible from at least one recession within said cap said cap further comprising a sealing plug for engagement on closure with an orifice; said connection further comprises a hinging structure connecting said cap to said base structure.

9. A flexibly activated the locking closure for secure product packaging of the type having a container with a discharge opening therein, said locking closure comprising:

a cap having a top outward facing surface, and an inner surface, the cap having an access hole formed through it, and a lock receptor extending from the inner surface of the cap the lock receptor having a notch formed in it;

a base structure having a top surface and a bottom surface, the base having at least one aperture extending from the bottom surface to the top surface for dispensing an item, the base having a recessed portion extending from the bottom surface;

the cap being attached to the base through a hinged connection such that the lower surface of the cap is adjacent to the upper surface of the base structure when the cap is in a closed position;

at least one flexible locking member having a first end mounted in the recess such that the flexible locking member extends out of the recess, the flexible locking member having a locking lip on a second end, the locking lip adapted to removably engage with the lock receptor on the cap for locking the cap to the base structure when the cap is in the closed position;

wherein the locking lip of the flexible locking member is located below the top surface of the cap when the flexible locking member is engaged with the lock receptor.

10. A closure as set forth in claim 9, wherein said closure comprises a polymer further comprising polypropylene.

11. A closure as set forth in claim 10, wherein said polymer is of a customizable crystallinity.

12. A closure as set forth in claim 10, wherein said polymer is semicrystalline.

13. A closure as set forth in claim 9, wherein said closure comprises a deformation resistant seal wherein said seal comprises a selectable transition cycle selectively cycling a tamper resistant state to a non-tamper resistant state.

14. A closure of claim 9, wherein said closure connects manually absent a connector said connector comprising a hinging structure.

15. A closure of claim 9, further comprising at least one of an indentation groove for opening said closure.

16. A closure of claim 9, wherein said aperture is selectively molded to a size determined at manufacturing time.

17. A closure of claim 9, wherein said aperture is customizably molded to approximate a material distribution sizing; said aperture material distribution sizing further comprising at least one of a pill sizing, a particulate matter sizing, or a liquid material distribution sizing.

18. A closure of claim 9, wherein said aperture is molded to form at least one of several narrow stream flows from said container.

19. A closure of claim 9, wherein said aperture is selectively molded to a size for dispensing granular particulate material flow.

20. A closure of claim 9, further comprising a selectively formed resiliency to environment factors comprising temperature; altitude; and material product for flow through said closure; further wherein said closure is formed via molding comprising injection molding, co-injected molding or direct insertion molding further comprising formation on or into a nozzle.

* * * * *